US010297224B2

(12) United States Patent
Enami

(10) Patent No.: US 10,297,224 B2
(45) Date of Patent: May 21, 2019

(54) ELECTROOPTICAL DEVICE, CONTROL METHOD OF ELECTROOPTICAL DEVICE, AND ELECTRONIC DEVICE

(71) Applicant: SEIKO EPSON CORPORATION, Tokyo (JP)

(72) Inventor: Shinta Enami, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 162 days.

(21) Appl. No.: 15/436,112

(22) Filed: Feb. 17, 2017

(65) Prior Publication Data

US 2017/0270888 A1 Sep. 21, 2017

(30) Foreign Application Priority Data

Mar. 17, 2016 (JP) ..... 2016-054112

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2310/0248* (2013.01)

(58) Field of Classification Search
None
See application file for complete search history.

(56) References Cited

U.S. PATENT DOCUMENTS

2012/0056917 A1 3/2012 Ito

FOREIGN PATENT DOCUMENTS

JP 2006-308712 A 11/2006
JP 2012-053407 A 3/2012

*Primary Examiner* — Gustavo Polo
(74) *Attorney, Agent, or Firm* — Oliff PLC

(57) ABSTRACT

Precharge thinning drive is performed without causing rotation noise and without requiring complicated control. A signal generation circuit that supplies an image signal with a magnitude in accordance with a tone to be displayed to pixels via data lines in a tone display period and supplies a precharge voltage to the data lines in a precharge period before the tone display period in one horizontal scanning period, a signal distribution circuit that is provided between the signal generation circuit and the data lines and selects the data lines, and a control circuit that controls the signal distribution circuit such that a predetermined number of data lines are alternately not selected in the precharge period are provided, and the control circuit controls the signal distribution circuit such that non-selection of the data line is different every predetermined horizontal scanning period.

5 Claims, 10 Drawing Sheets

| V COUNTER / H COUNTER | 0 | 1 |
|---|---|---|
| 0 | ODD NUMBER SEL (SEL[1], SEL[3], SEL[5], SEL[7]) | EVEN NUMBER SEL (SEL[2], SEL[4], SEL[6], SEL[8]) |
| 1 | EVEN NUMBER SEL (SEL[2], SEL[4], SEL[6], SEL[8]) | ODD NUMBER SEL (SEL[1], SEL[3], SEL[5], SEL[7]) |

ELECTROOPTICAL DEVICE, CONTROL METHOD OF ELECTROOPTICAL DEVICE, AND ELECTRONIC DEVICE

BACKGROUND

1. Technical Field

The present invention relates to technical fields of an electrooptical device such as a liquid crystal device, a control method of the electrooptical device, and an electronic device provided with the electrooptical device, such as a liquid crystal projector.

2. Related Art

Electrooptical devices that use liquid crystal elements to display images have widely been developed. According to such electrooptical devices, the transmittance of liquid crystals provided in the respective pixels is controlled to be a transmittance in accordance with designated tones of image signals by supplying the image signals for designating the display tones of the respective pixels to the respective pixels via data lines, and in doing so, the respective pixels are made to display the tones designated by the image signals.

Incidentally, in a case where image signals are not sufficiently supplied, for example, in a case where sufficient time for supplying image signals to the respective pixels cannot be secured, the respective pixels cannot accurately display the tones designated by the image signals, and display quality may deteriorate. In order to respond to the problem of the deterioration of display quality due to such insufficient writing of the image signals in the pixels, the following measure is employed in the related art. For example, a technology of facilitating the writing of image signals in the respective pixels by supplying a precharge signal with a potential that is close to a potential of the image signals to the respective pixels and the data lines prior to the supply of the image signals has been proposed.

The precharge signal is an auxiliary signal for writing a voltage in all the data lines or control lines connected to the data lines in advance prior to the writing of the image signals. Writing support and various correction failures are improved by writing a specific voltage (precharge signal) in the period.

Also, a drive scheme called two-stage precharge drive of supplying a low-potential precharge signal prior to supply of a precharge signal with a potential that is as high as the potential of the image signals has been proposed. According to the two-stage precharge drive, it is possible to achieve both improvement in image quality and writing support.

However, it is necessary to shorten one horizontal scanning period in accordance with increases in the numbers of scanning lines and data lines associated with an increase in resolution of an electrooptical device, and as a result, a horizontal fly-back period during which the precharge signal is supplied also tends to be shortened. Thus, a drive scheme called precharge thinning drive in which only a high-potential precharge signal in the two-stage precharge is supplied in an arbitrary horizontal scanning period has also been proposed in the related art (JP-A-2006-308712, for example). According to the precharge thinning drive, it is possible to shorten the precharge signal supply period and to shorten one horizontal scanning period by supplying only the high-potential precharge signal.

However, since the thinning drive is performed every predetermined horizontal scanning period in the method disclosed in JP-A-2006-308712, a rotation cycle may be delayed, and rotation noise may appear in display. In addition, there is also a problem that control becomes complicated since control performed across a plurality of lines is required.

SUMMARY

An advantage of some aspects of the invention is to provide an electrooptical device that efficiently performs precharge thinning drive without causing noise and without requiring complicated control, a control method of the electrooptical device, and an electronic device provided with the electrooptical device.

According to an aspect of the invention, there is provided an electrooptical device including: a plurality of scanning lines; a plurality of data lines; pixels that are provided so as to correspond to intersections between the plurality of scanning lines and the plurality of data lines; a scanning line drive unit that supplies a scanning signal to the scanning lines; a data line drive unit that supplies a first voltage with a magnitude in accordance with a tone to be displayed to the pixels via the data lines in a first period and supplies a second voltage to the data lines in a second period before the first period in one horizontal scanning period; a data line selection unit that is provided between the data line-drive unit and the data lines and selects the data lines; and a control unit that controls the data line selection unit such that a predetermined number of data lines are alternately not selected in the second period, in which the control unit controls the data line selection unit such that non-selection of the data line is different every predetermined horizontal scanning period.

According to the aspect, the data line drive unit supplies the first voltage with the magnitude in accordance with the tone to be displayed to the pixels via the data lines in the first period. Before the first voltage is supplied, the second voltage is supplied to the data lines in the second period before the first period. An improvement in image quality is realized by supplying the second voltage to the data lines. However, the control unit controls the data line selection unit such that the predetermined number of data lines are alternately not selected when specific scanning lines are selected in the second period. Furthermore, the control unit controls the data line selection unit such that non-selection of the data line is different every predetermined horizontal scanning period. Therefore, it is possible to shorten one horizontal scanning period. Furthermore, since locations to which the second voltage is supplied are distributed in units of pixels and are dispersed in a scanning line direction and a data line direction, a difference from locations to which the second voltage is not supplied does not significantly appear. The data line selection unit is controlled in units of one horizontal scanning period, and it is not necessary to change a duty of the signal for selecting data lines in one horizontal scanning period, which makes it possible to simplify the control.

In this case, the control unit may control the data line selection unit such that odd-numbered data lines or even-numbered data lines are not in the second period and may control the data line selection unit such that non-selection of the data line is different every horizontal scanning period. According to the aspect, it is possible to shorten one horizontal scanning period. Furthermore, since locations to which the second voltage is supplied are distributed in units of pixels in the scanning line direction and the data line direction, a difference from the locations to which the second voltage is not supplied does not significantly appear. Also, the data line selection unit is controlled in units of one horizontal scanning period, and it is not necessary to change a duty of the signal for selecting data lines in one horizontal scanning period, which makes it possible to simplify the control.

In this case, the first period may include a tone display period, the second period may include a•fly-back period, and the second voltage may include a precharge voltage. According to the aspect, the first voltage is written in the pixels via the data lines in the tone display period, and the precharge voltage is written in the data lines in the fly-back period. The control unit controls the data line selection unit such that a predetermined number of data lines are not selected when specific scanning lines are selected and the precharge voltage is written therein. Furthermore, the control unit controls the data line selection unit such that non-selection of the data line is different every predetermined horizontal scanning period when the precharge voltage is written. Therefore, it is possible to shorten one horizontal scanning period. Furthermore, since locations to which the precharge voltage is supplied are distributed in units of pixels and are dispersed in the scanning line direction and the data line direction, a difference from the locations to which the precharge voltage is not supplied does not significantly appear. The data line selection unit is controlled in units of one horizontal scanning period, and it is not necessary to change a duty of the signal for selecting data lines in one horizontal scanning period, which makes it possible to simplify the control.

According to another aspect of the invention, there is provided a control method of an electrooptical device that includes a plurality of scanning lines and a plurality of data lines, the method including: supplying a first voltage with a magnitude in accordance with a tone to be displayed to the data lines in a first period in a horizontal scanning period; supplying a second voltage that is different from the first voltage to a predetermined number of data lines in a second period before the first period in the horizontal scanning period; and supplying the second voltage to different data lines every predetermined horizontal scanning period.

In this case, the second voltage may be supplied to either odd-numbered data lines or even-numbered data lines in the second period, and the second voltage may be supplied to different data lines every horizontal scanning period.

In this case, the first period may include a tone display period, the second period may include a fly-back period, and the second voltage may include a precharge voltage.

According to these aspects, the data line drive unit supplies the first voltage with the magnitude in accordance with the tone to be displayed to the pixels via the data lines in the first period. Before the first voltage is supplied, the second voltage is supplied to the data lines in the second period before the first period. An improvement in image quality is realized by supplying the second voltage to the data lines. However, the data line selection unit is controlled such that the predetermined number of data lines are not selected when specific scanning lines are selected in the second period. Furthermore, the data line selection unit is controlled such that non-selection of the data line is different every predetermined horizontal scanning period. Therefore, it is possible to shorten one horizontal scanning period. Furthermore, since locations to which the second voltage is supplied are distributed in units of pixels and are dispersed in the scanning line direction and the data line direction, the difference from the locations to which the second voltage is not supplied does not significantly appear. The data line selection unit is controlled in units of one horizontal scanning period, and it is not necessary to change a duty of the signal for selecting data lines in one horizontal scanning period, which makes it possible to simplify the control.

According to still another aspect of the invention, there is provided an electronic device including: the aforementioned electrooptical device. According to such an electronic device, one horizontal scanning period is shortened in a display device such as a liquid crystal display. Therefore, it is possible to provide an electronic device capable of reliably writing the first voltage and the second voltage and exhibiting high image quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
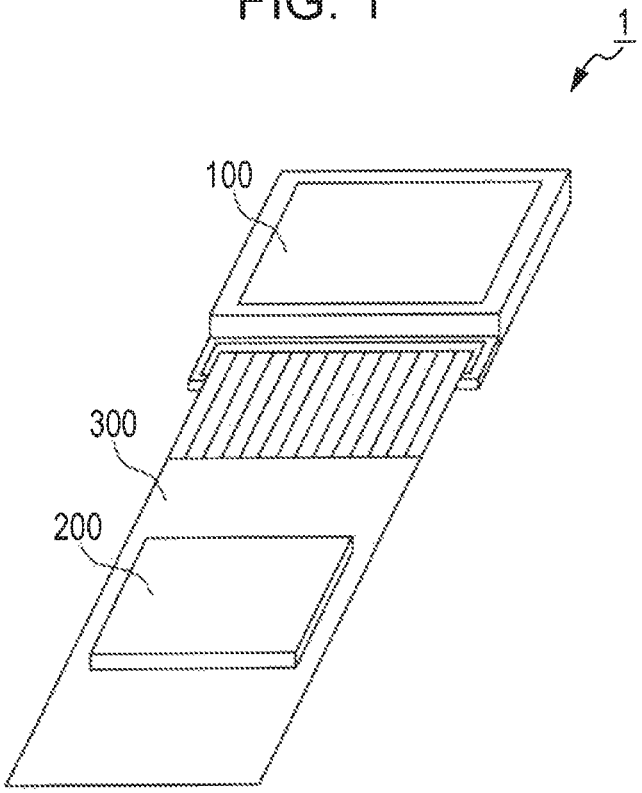
FIG. 1 is an explanatory diagram of an electrooptical device according to a first embodiment of the invention.

Description will be given of a first embodiment of the invention with reference to FIGS. 1 to 9. FIG. 1 is a diagram illustrating a configuration of a signal transmission system for an electrooptical device 1. As illustrated in FIG. 1, the electrooptical device 1 includes an electrooptical panel 100, a drive integrated circuit 200, and a flexible circuit board 300, and the electrooptical panel 100 is connected to the flexible circuit board 300 on which the drive integrated circuit 200 is mounted. The electrooptical panel 100 is connected to a substrate of a host CPU device, which is not illustrated in the drawing, via the flexible circuit board 300 and the drive integrated circuit 200. The drive integrated circuit 200 is a device that receives image signals and various control signals for drive and control from the host CPU device via the flexible circuit board 300 and drives the electrooptical panel 100 via the flexible circuit board 300.

Figure 2:
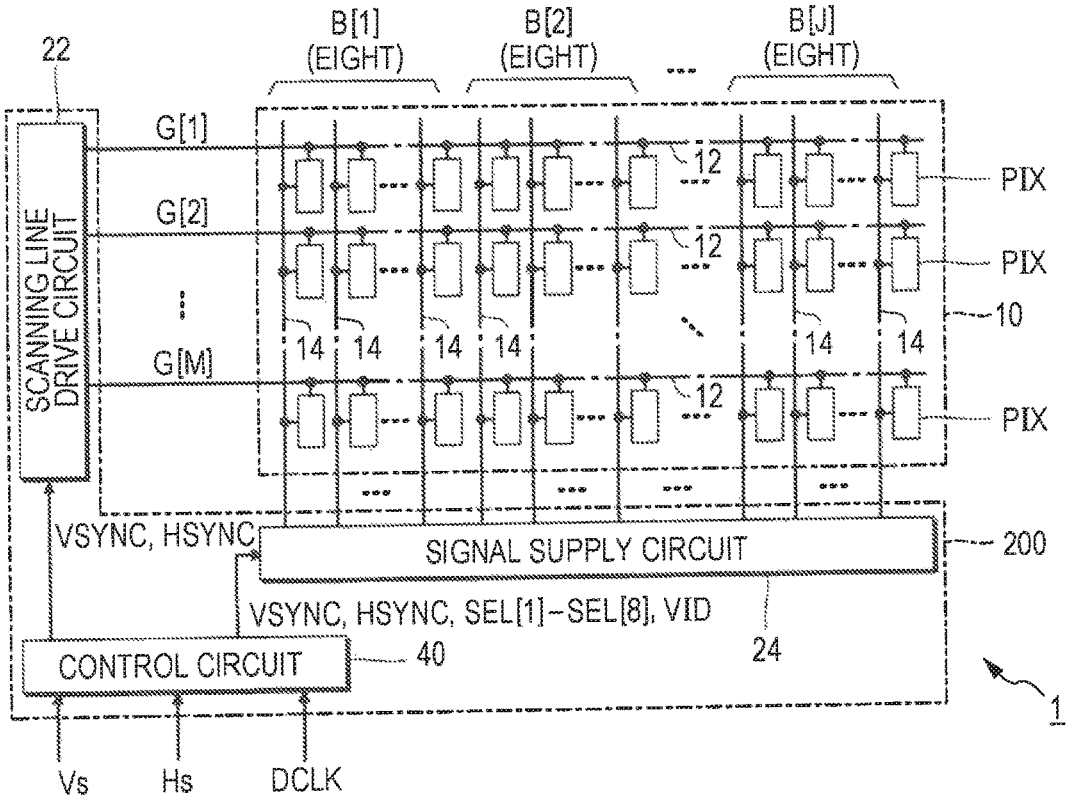
FIG. 2 is a block diagram illustrating a configuration of the electrooptical device according to the embodiment.

FIG. 2 is a block diagram illustrating a configuration of the electrooptical device 1. As illustrated in FIG. 2, the electrooptical device 1 includes a pixel unit 10 and a drive integrated circuit 200. The drive integrated circuit 200 includes a scanning line drive circuit 22 as the scanning line drive unit, a signal supply circuit 24 and a control circuit 40 as the control unit. The signal supply circuit 24 includes a signal generation circuit 52 as the data line drive unit and a signal distribution circuit 54 as the data line selection unit as will be described later.

In the pixel unit 10, M scanning lines 12 and N data lines 14 that intersect each other are formed (M and N are natural numbers). A plurality of pixel circuits (pixels) PIX are provided so as to correspond to intersections between the respective scanning lines 12 and the respective data lines 14 and are aligned in a matrix shape of M rows in the longitudinal direction and N columns in the transverse direction. As illustrated in FIG. 2, N data lines 14 in the pixel unit 10 are divided into J wiring groups (blocks) B[1] to B[J] in units of eight (K=8) mutually adjacent data lines 14 in one example (J=N/8, and N is a multiple number of 8 in this example). In other words, the data lines are grouped into wiring groups B.

Figure 3:
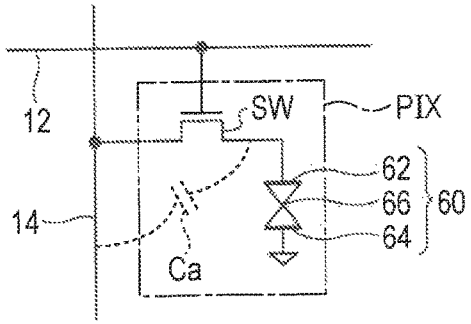
FIG. 3 is a circuit diagram illustrating a configuration of a pixel.

FIG. 3 is a circuit diagram of each pixel circuit PIX. As illustrated in FIG. 3, each pixel circuit PIX includes a liquid crystal element 60 and a switching element SW such as a TFT. The liquid crystal element 60 is an electrooptical element configured of a pixel electrode 62 and a common electrode 64, which face each other, and a liquid crystal 66 between both the electrodes. Transmittance (display tone) of the liquid crystal 66 varies in accordance with a voltage applied between the pixel electrode 62 and the common electrode 64. Another configuration is also employed in which an auxiliary capacitance is connected in parallel with the liquid crystal element 60. The switching element SW is formed of an N-channel transistor with a gate connected to the scanning line 12, for example, is provided between the liquid crystal element 60 and the data line 14, and controls electrical connection (conduction/non-conduction) therebetween. The switching elements SW in the respective pixel circuits PIX on the m-th row are shifted to an ON state at the same time by setting the scanning signal G[m] to a selection potential (m=1 to M).

When the scanning lines 12 corresponding to the pixel circuits PIX are selected and the switching elements SW in the pixel circuits PIX are controlled and brought into the ON state, a voltage in accordance with an image signal D supplied from the data lines 14 to the pixel circuits PIX is applied to the liquid crystal elements 60. As a result, the liquid crystals 66 in the pixel circuits PIX are set to have transmittance in accordance with the image signal D. If a light source that is not illustrated in the drawing is brought into an ON (turned-on) state and light is emitted from the light source, the light penetrates through the liquid crystals 66 of the liquid crystal elements 60 provided in the pixel circuits PIX and advances toward a side of an observer. That is, the pixels corresponding to the pixel circuits PIX display a tone corresponding to the image signal D by the voltage in accordance with the image signal D being applied to the liquid crystal element 60 and the light source being brought into the ON state.

If the switching elements SW are turned into an OFF state after the voltage in accordance with the image signal D is applied to the liquid crystal elements 60 of the pixel circuits PIX, the applied voltage corresponding to the image signal D is ideally held. Therefore, the respective pixels ideally display the tone in accordance with the image signal D in a period after the switching elements SW are brought into the ON state and until the switching element are brought into the ON state next time.

As illustrated in FIG. 3, a capacitance Ca is parasitic between the data line 14 and the pixel electrode 62 (or between the data line 14 and a wiring that electrically connects the pixel electrode 62 and the switching element SW). Therefore, variations in the potential of the data line 14 propagates to the pixel electrode 62 via the capacitance Ca and the application voltage of the liquid crystal element 60 varies while the switching element SW is in the OFF state, in some cases.

In addition, a common voltage LCCOM as a constant voltage is supplied to the common electrode 64 via a common line that is not illustrated in the drawing. As the common voltage LCCOM, a voltage of about −0.5 V is used on the assumption that the center voltage of the image signal D is 0 V. This is based on properties of the switching element SW and the like.

In order to prevent so-called ghosting, polarity reversion drive of reversing polarity of the voltage to be applied to the liquid crystal element 60 in a predetermined period is employed in this embodiment. In this example, the level of the image signal D supplied to the pixel circuits PIX via the data lines 14 is reversed every unit period with respect to the center voltage of the image signal D. The unit period is a period corresponding to one unit of the operation of driving the pixel circuit PIX. In this example, the unit period is a vertical scanning period V. However, the unit period can be arbitrarily set and may be a multiple natural number of the vertical scanning period V, for example. In this embodiment, a case where the image signal D has a higher voltage than the center voltage of the image signal D will be regarded as positive polarity, and a case where the image signal D has a lower voltage than the center voltage of the image signal D will be regarded as negative polarity.

Description will be returned to FIG. 2. The external host CPU device that is not illustrated in the drawing inputs external signals such as a vertical synchronization signal Vs, a horizontal synchronization signal Hs, and a dot clock signal DCLK to the control circuit 40. The control circuit 40 supplies a synchronization signal VSYNC that defines the vertical scanning period V and a synchronization signal HSYNC that defines the horizontal scanning period H to the scanning line drive circuit 22 and the signal supply circuit 24 based on these signals. The control circuit 40 controls and synchronizes the scanning line drive circuit 22 and the signal supply circuit 24 as described above. Under such synchronization and control, the scanning line drive circuit 22 and the signal supply circuit 24 cooperate to perform display control of the pixel unit 10. In addition, the control circuit 40 supplies an image signal VID for designating the tone of each pixel PIX in a time division manner and eight selection signals SEL[1] to SEL[8] corresponding to the number of data lines 14 in each wiring group B[j] (j=1 to J) to the signal supply circuit 24.

Generally, display data configuring one display screen is processed in unit of frames, and a processing period is one frame period (1F). The frame period F corresponds to the vertical scanning period V in a case where one display screen is formed of vertical scanning performed once.

The scanning line drive circuit 22 outputs scanning signals G[1] to G[M] to each of M scanning lines 12. The scanning line drive circuit 22 sequentially brings the scanning signals G[1] to G[M] to the respective scanning lines 12 into an active level in every horizontal scanning period (1H) during the vertical scanning period V in accordance with an output of the horizontal synchronization signal Hs from the control circuit 40.

Here, the respective switching elements SW in N pixel circuits PIX on the m-th row are in the ON state during a period in which the scanning signal G[m] corresponding to the m-th row is in the active level and the scanning lines corresponding to the row are selected. As a result, the N data lines 14 are electrically connected to the respective pixel electrodes 62 in the N pixel circuits PIX on the m-th row via these respective switching elements SW.

Figure 4:
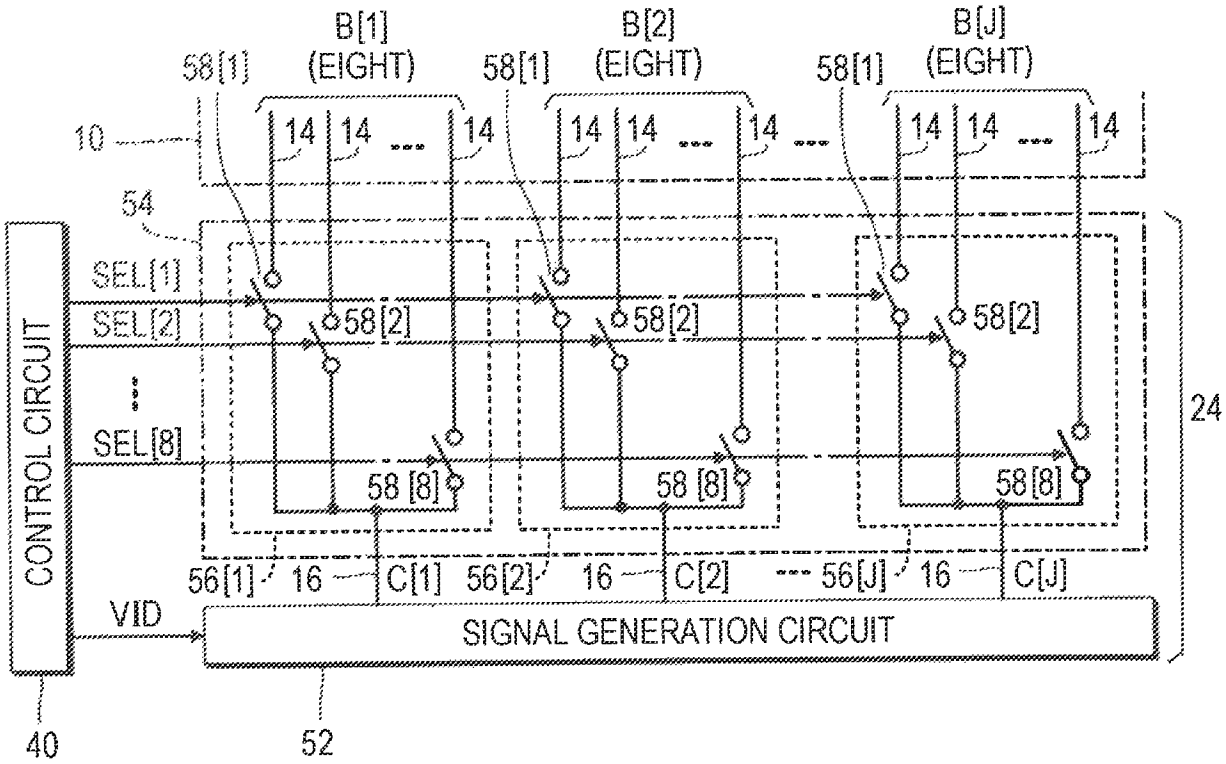
FIG. 4 is a block diagram illustrating a configuration of a signal supply circuit of the electrooptical device.

FIG. 4 is a block diagram of the signal supply circuit 24. As illustrated in FIG. 4, the signal supply circuit 24 includes the signal generation circuit 52 as the data line drive unit and the signal distribution circuit 54 as the data line selection unit. The signal generation circuit 52 and the signal distribution circuit 54 are connected to each other by J control lines 16 corresponding to mutually difference wiring groups B[j]. The signal generation circuit 52 is mounted in the form of an integrated circuit (chip), and the scanning line drive circuit 22 and the signal distribution circuit 54 are formed of thin-film transistors formed on the surface of the same substrate as that of the pixels PIX. However, the mounting form of the drive integrated circuit 200 may be arbitrarily changed. In addition, the signal distribution circuit 54 may be provided along the pixel unit 10 of the electrooptical panel 100 instead of the drive integrated circuit 200.

Figure 5:
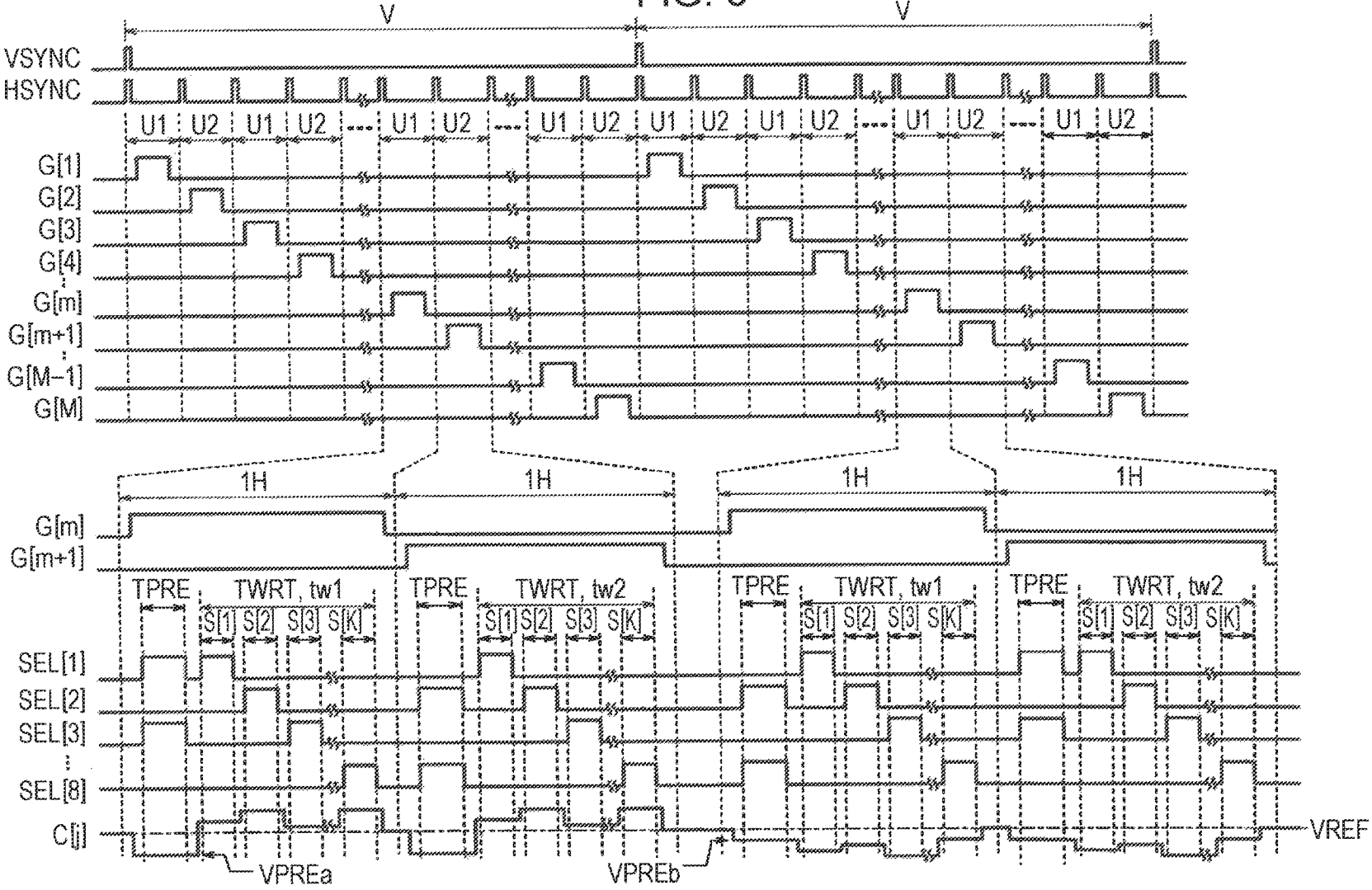
FIG. 5 is a timing chart of a drive integrated circuit.

The signal generation circuit 52 in FIG. 4 supplies J control signals C[1] to C[J] corresponding to mutually different wiring groups B[j] to the respective control lines 16 in parallel. The signal generation circuit 52 the control signals C[1] to C[J] to a precharge voltage VPRE (VPREa and VPREb) as the second voltage in a precharge period TPRE as the second period included in the fly-back period in one horizontal scanning period (1H) as illustrated in FIG. 5. The precharge voltage VPRE is set to a potential of negative polarity with respect to a predetermined reference potential VREF (a potential corresponding to an amplitude center of the tone potential VG, for example).

The signal generation circuit 52 sets the control signal C[j] to the tone potential VG in accordance with the designated tone for the eight pixels PIX corresponding to the respective intersections between the scanning lines 12 on the m-th row and the eight data lines 14 in the wiring group B[j] in the time division manner in a tone display period TWRT as the first period in one horizontal scanning period (1H), in which the scanning lines 12 on the m-th row are selected. The designated tone of the respective pixels PIX is defined by the image signal VID supplied from the control circuit 40. The polarity of the tone potential VG with respect to the reference potential VREF is periodically (every vertical scanning period V, for example) and sequentially reversed. The respective control signals C[1] to C[J] are set to the precharge voltage VPREa in the precharge period TPRE immediately before the tone display period TWRT in which the tone potential VG is set to have positive polarity with respect to the reference potential VREF. In addition, the respective control signals C[1] to C[J] are set to the precharge voltage VPREb in the precharge period TPRE immediately before the tone display period TWRT in which the tone potential VG is set to have negative polarity. The precharge voltage VPREa is set as a lower voltage than the precharge voltage VPREb (a voltage with a large difference from the reference potential VREF).

As illustrated in FIG. 4, the signal distribution circuit 54 includes J distribution circuits 56[1] to 56[J] corresponding to the mutually different wiring groups B[j](j=1 to J). The j-th distribution circuit 56[j] is a circuit that distributes the control signal C[j] to be supplied to the j-th control line 16 to each of eight data lines 14 in the wiring group B[j]. The distribution circuit 56[j] includes eight switches 58[1] to 58[8] corresponding to the mutually different data lines 14 in the wiring group B[j]. The k-th switch 58[k] (k=1 to K, K=8 in this example) in the distribution circuit 56[j] is interposed between the k-th data line 14 among the eight data lines 14 in the wring group B[j] and the j-th control line 16 in the J control lines 16 and controls electrical connection (conduction/non-conduction) therebetween. The respective selection signals SEL[k] generated by the control circuit 40 are supplied to gates of k-th switches 58[k] (a total of J switches 58[k] in the signal distribution circuit 54) in the J distribution circuit 56[1] to 56[J] in parallel.

The control circuit 40 includes a frame memory, at least has a memory space of M×N bits corresponding to resolution of the pixel unit 10, and stores and holds, in units of frames, display data input from the external host CPU device that is not illustrated in the drawing. Here, the display data that defines the tone of the pixel unit 10 is 64-tone data configured of 6 bits in one example. The display data read from the frame memory is transferred as the image signal VID in series to the signal generation circuit 52 via a 6-bit bus.

The control circuit 40 may be configured to include a line memory for at least one line. In such a case, the image signal VID for one line is accumulated in the line memory, and the image signal VID is transferred to the respective pixels.

The signal generation circuit 52 includes a D/A (Digital to Analog) conversion circuit as a D/A conversion unit and a voltage amplification unit. The D/A conversion circuit performs D/A conversion based on grouped digital data and an analog voltage generated by an analog voltage generation circuit, further performs amplification by the voltage amplification unit, and generates a voltage as analog data. In doing so, the image signal VID in a chronological order in units of eight pixels is also converted into a predetermined data voltage (first voltage) corresponding to the tone potential VG in this example. The precharge signal is also supplied from the control circuit 40 and is converted into a predetermined precharge voltage (second voltage), and a set of the precharge voltage and the data voltage for the eight pixels is supplied to the respective control lines 16 in this order. As described above, the signal generation circuit 52 also functions as an output unit of the precharge voltage as the second voltage.

Figures 6, 7:
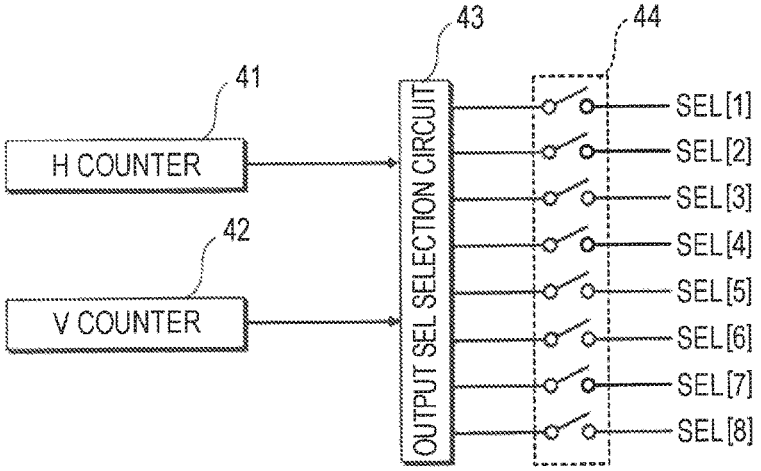
FIG. 6 is a block diagram illustrating a configuration of a selection circuit of a data line selection signal.
FIG. 7 is a diagram illustrating a relationship between counter values and selection signals during supply of a precharge voltage in the selection circuit in FIG. 6.

Next, description will be given of thinning drive of the precharge voltage according to the embodiment. FIG. 6 is a block diagram illustrating a configuration of a selection circuit of selection signals SEL[1] to SEL[8] for the data lines 14, which is provided in the control circuit 40. As illustrated in FIG. 6, the selection circuit of the selection signals SEL[1] to SEL[8] for the data lines 14 includes a 1-bit H counter 41, a 1-bit V counter 42, an output SEL selection circuit 43, and switches 44. The V counter 42 operates in synchronization with a synchronization signal VSYNC, is set to a value "0" in the first vertical scanning period V, and is set to a value "1" in the next vertical scanning period V, for example. In addition, the H counter 41 operates in synchronization with a synchronization signal HSYNC, is set to a value "0" in the first horizontal scanning period H, and is set to a value "1" in the next horizontal scanning period H, for example.

The output SEL selection circuit 43 turns on and off the switches 44 based on the values of the H counter 41 and the V counter 42. In the embodiment, the output SEL selection circuit 43 turns on and off the switches 44 in accordance with a rule illustrated in FIG. 7 in one example. FIG. 7 is a diagram illustrating a relationship between counter values and the selection signals SEL[1] to SEL[8] during supply of the precharge voltage in the selection circuit in FIG. 6. In the first vertical scanning period V, for example, the value of the V counter 42 is "0". Therefore, the output SEL selection circuit 43 brings the corresponding switches 44 into the ON state such that the odd-numbered selection signals SEL[1], SEL[3], SEL[5], and SEL[7] become active when the value of the H counter 41 becomes "0" in the first horizontal scanning period H. The output SEL selection circuit 43 brings the corresponding switches 44 into the ON state such that even-numbered selection signals SEL[2], SEL[4], SEL [6], and SEL[8] become active when the value of the H counter 41 becomes "1" in the next horizontal scanning period H. The output SEL selection circuit 43 similarly perform the processing thereafter. That is, the odd-numbered selection signals SEL[1], SEL[3], SEL[5], and SEL[7] and even-numbered selection signals SEL[2], SEL[4], SEL[6], and SEL[8] are sequentially brought into the active state every one horizontal scanning period (1H). That is, the switches 44 corresponding to these selection signals SEL are brought into the ON state.

Next, description will be given of an example of thinning drive of the precharge voltage according to the embodiment with reference to the timing chart in FIG. 5. FIG. 5 is a timing chart of the drive integrated circuit 200. As illustrated in FIG. 5, the control circuit 40 performs control as follows in the first vertical scanning period (positive polarity drive period). The control circuit 40 sets the odd-numbered selection signals SEL[1], SEL[3], SEL[5], and SEL[7] in the active level (a potential for shifting the switches 58[k] into the ON state) in the precharge period TPRE in one horizontal scanning period, in which the scanning lines 12 on the m-th row are selected. Therefore, all (J×8) switches 58[k] in the signal distribution circuit 54 are shifted to the ON state in the precharge period TPRE in the one horizontal scanning period. As a result, the precharge voltage VPRE is supplied to the odd-numbered data lines 14 from among the N data lines 14 and the pixel electrodes 62 in the respective pixels PIX corresponding to intersections between the data lines 14 and the scanning lines 12 on the m-th row. It is possible to prevent tone irregularity (vertical crosstalk) in a display image since the potential of the respective data lines 14 is initialized to the precharge voltage VPRE before the tone potential VG is supplied (before writing) to the respective pixels PIX as described above.

In contrast, the control circuit 40 sets the eight selection signals SEL[1] to SEL[8] in the active level in order in eight selection periods S[1] to S[8] in the tone display period TWRT in one horizontal scanning period, in which the scanning lines 12 on the m-th row are selected. Therefore, the k-th switch 58[k] from among the eight switches 58[1] to 58[8] in each of the distribution circuits 56[1] to 56[J] is shifted to the ON state in the selection period S[k] in the one horizontal scanning period, in which the scanning lines 12 on the m-th row are selected. Here, a total of J switches 58[k] are present in the signal distribution circuit 54. As a result, the tone potential VG of the control signal C[j] is supplied to the data lines 14 on the k-th column in the respective wiring groups B[j]. That is, the tone potential VG is supplied in the time division manner to the eight data lines 14 in the wiring group B[j], namely each of the J wiring groups B[1] to B[J] in the tone display period TWRT in the one horizontal scanning period. The tone potential VG is set in accordance with the designated tone for the pixels PIX corresponding to intersections between the scanning lines 12 on the m-th row and the data lines 14 on the k-th column in the wiring group B[j] in the selection period S[k] in the m-th horizontal scanning period H.

Next, the control circuit 40 sets the even-numbered selection signals SEL[2], SEL[4], SEL[6], and SEL[8] in the precharge period TPRE in one horizontal scanning period, in which the scanning lines 12 on the m+1_th row are selected in the first vertical scanning period V as illustrated in FIG. 5. That is, the even-numbered selection signals SEL[2], SEL[4], SEL[6], and SEL[8] are set to the potential for shifting the switches 58[k] into the ON state. Therefore, all (J×8) switches 58[k] in the signal distribution circuit 54 are shifted to the ON state in the precharge period TPRE in the one horizontal scanning period. As a result, the precharge voltage VPRE is supplied to the even-numbered data lines 14 from among the N data lines 14 and the pixel electrodes 62 in the respective pixels PIX corresponding to intersections between the data lines 14 and the scanning lines 12 on the m+1-th row. It is possible to prevent tone irregularity (vertical crosstalk) in a display image since the potential of the respective data lines 14 is initialized to the precharge voltage VPRE before the tone potential VG is supplied (before writing) to the respective pixels PIX as described above.

In contrast, the control circuit 40 sets the eight selection signals SEL[1] to SEL[8] in the active level in order in the eight selection periods S[1] to S[8] in the tone display period TWRT in one horizontal scanning period, in which the scanning lines 12 on the m+1-th row are selected. Therefore, the k-th switch 58[k] from among the eight switches 58[1] to 58[8] in each of the distribution circuits 56[1] to 56[J] is shifted to the ON state in the selection period S[k] in the one horizontal scanning period. Here, a total of J switches 58[k] are present in the signal distribution circuit 54. As a result, the tone potential VG of the control signal C[j] is supplied to the data lines 14 on the k-th column in the respective wiring groups B[j]. That is, the tone potential VG is supplied in the time division manner to the eight data lines 14 in the wiring group B[j], namely each of the J wiring groups B[1] to B[J] in the tone display period TWRT in the one horizontal scanning period. The tone potential VG is set in accordance with the designated tone for the pixels PIX corresponding to intersections between the scanning lines 12 on the m+1-th row and the data lines 14 on the k-th column in the wiring group B[j] in the selection period S[k] in the m+1-th horizontal scanning period H.

Thereafter, the operations of writing the precharge voltage and the tone potential in the vertical scanning period V are repeated in the same manner.

The control circuit 40 sets the even-numbered selection signals SEL[2], SEL[4], SEL[6], and SEL[8] in the active level in the precharge period TPRE in one horizontal scanning period, in which the scanning lines 12 on the m-th row are selected in the next vertical scanning period V (the period of negative polarity drive) illustrated in FIG. 5. That is, the even-numbered selection signals SEL[2], SEL[4], SEL[6], and SEL[8] are set to the potential for shifting the switches 58[k] into the ON state. Therefore, all (J×8) switches 58[*k*] in the signal distribution circuit 54 are shifted to the ON state in the precharge period TPRE in the one horizontal scanning period. As a result, the precharge voltage VPRE is supplied to the even-numbered data lines 14 from among the N data lines 14 and the pixel electrodes 62 in the respective pixels PIX corresponding to intersections between the data lines 14 and the scanning lines 12 on the m-th row. It is possible to prevent tone irregularity (vertical crosstalk) in a display image since the potential of the respective data lines 14 is initialized to the precharge voltage VPRE before the tone potential VG is supplied (before writing) to the respective pixels PIX as described above.

In contrast, the control circuit 40 sets the eight selection signals SEL[1] to SEL[8] in the active level in order in the eight selection periods S[1] to S[8] in the tone display period TWRT in one horizontal scanning period, in which the scanning lines 12 on the m-th row are selected. Therefore, the k-th switch 58[k] from among the eight switches 58[1] to 58[8] in each of the distribution circuits 56[1] to 56[J] is shifted to the ON state in the selection period S[k] in the one horizontal scanning period. Here, a total of J switches 58[k] are present in the signal distribution circuit 54. As a result, the tone potential VG of the control signal C[j] is supplied to the data lines 14 on the k-th column in the respective wiring groups B[j]. That is, the tone potential VG is supplied in the time division manner to the eight data lines 14 in the wiring group B[j], namely each of the J wiring groups B[1] to B[J] in the tone display period TWRT in the one horizontal scanning period. The tone potential VG is set in accordance with the designated tone for the pixels PIX corresponding to intersections between the scanning lines 12 on the m-th row and the data lines 14 on the k-th column in the wiring group B[j] in the selection period S[k] in the m-th horizontal scanning period H.

Next, the control circuit 40 sets the odd-numbered selection signals SEL[1], SEL[3], SEL[5], and SEL[7] in the precharge period TPRE in one horizontal scanning period, in which the scanning lines 12 on the m+1_th row are selected in the vertical scanning period V as illustrated in FIG. 5. That is, the odd-numbered selection signals SEL[1], SEL[3], SEL[5], and SEL[7] are set to the potential for shifting the switches 58[k] into the ON state. Therefore, all (J×8) switches 58[k] in the signal distribution circuit 54 are shifted to the ON state in the precharge period TPRE in the one horizontal scanning period. As a result, the precharge voltage VPRE is supplied to the odd-numbered data lines 14 from among the N data lines 14 and the pixel electrodes 62 in the respective pixels PIX corresponding to intersections between the data lines 14 and the scanning lines 12 on the m+1-th row. It is possible to prevent tone irregularity (vertical crosstalk) in a display image since the potential of the respective data lines 14 is initialized to the precharge voltage VPRE before the tone potential VG is supplied (before writing) to the respective pixels PIX as described above.

In contrast, the control circuit 40 sets the eight selection signals SEL[1] to SEL[8] in the active level in order in the eight selection periods S[1] to S[8] in the tone display period TWRT in one horizontal scanning period, in which the scanning lines 12 on the m+1-th row are selected. Therefore, the k-th switch 58[k] from among the eight switches 58[1] to 58[8] in each of the distribution circuits 56[1] to 56[J] is shifted to the ON state in the selection period S[k] in the one horizontal scanning period. Here, a total of J switches 58[k] are present in the signal distribution circuit 54. As a result, the tone potential VG of the control signal C[j] is supplied to the data lines 14 on the k-th column in the respective wiring groups B[j]. That is, the tone potential VG is supplied in the time division manner to the eight data lines 14 in the wiring group B[j], namely each of the J wiring groups B[1] to B[J] in the tone display period TWRT in the one horizontal scanning period. The tone potential VG is set in accordance with the designated tone for the pixels PIX corresponding to intersections between the scanning lines 12 on the m+1-th row and the data lines 14 on the k-th column in the wiring group B[j] in the selection period S[k] in the m+1-th horizontal scanning period H.

Thereafter, the operations of writing the precharge voltage and the tone potential in the vertical scanning period V are repeated in the same manner. Also, the operation of writing the precharge voltage and the tone potential are repeated in the following vertical scanning period V in the same manner.

Figure 8:
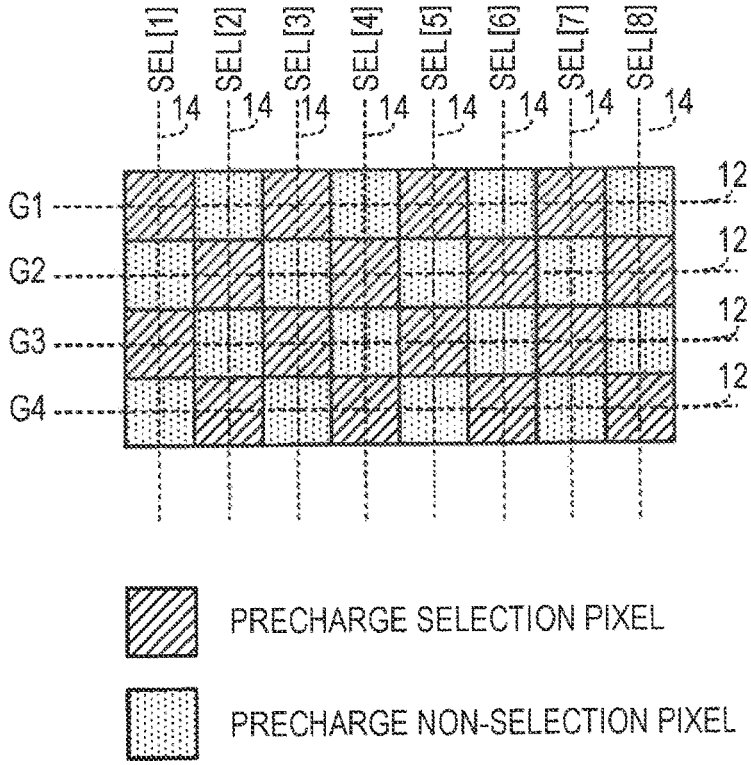
FIG. 8 is a diagram illustrating a data line selected and non-selected pattern during supply of the precharge voltage in an n-th frame according to the first embodiment.

According to the embodiment, the signal distribution circuit 54 is controlled such that every other data lines 14 (even-numbered data lines) are not selected instead of all the data lines 14 being selected at the same time in the precharge voltage writing period as described above. In addition, the signal distribution circuit 54 is controlled such that different data lines 14 are not selected every one horizontal scanning period (1H). Therefore, the data lines 14 and the pixels in which the precharge voltage is written are alternately arranged both in the direction of the scanning lines 12 and in the direction of the data lines 14 as illustrated in FIG. 8. FIG. 8 is a diagram illustrating a selected and non-selected pattern of the data lines 14 and the pixels when the precharge voltage is supplied in the n-th frame (n is a natural number) according to the embodiment.

Figure 9:
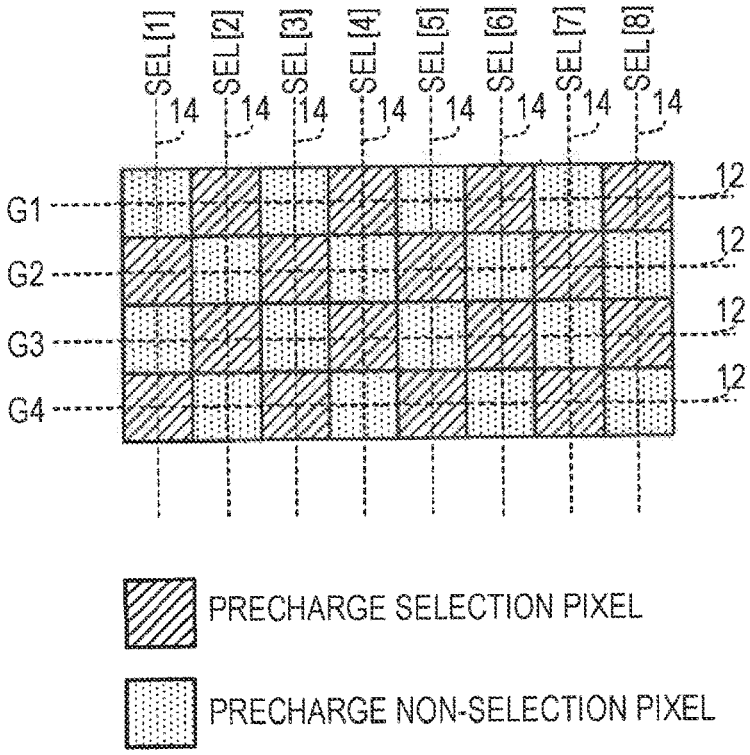
FIG. 9 is a diagram illustrating a data line selected and non-selected pattern during supply of the precharge voltage in an n+1-th frame according to the first embodiment.

FIG. 9 is a diagram illustrating a selected and non-selected pattern of the data lines and the pixels when the precharge voltage is supplied in the n+1-th frame according to the embodiment. As illustrated in FIG. 9, control is performed in the precharge voltage writing period for the n+1-th frame so as to obtain a different selection pattern from that in the n-th frame as illustrated in FIG. 8. That is, the signal distribution circuit 54 is controlled such that every other data lines 14 (odd-numbered data lines) are not selected and different data lines 14 are not selected every one horizontal scanning period (1H).

According to the embodiment, the data lines 14 and the pixels in which the precharge voltage is written are alternately arranged in the direction of the scanning lines 12 and the direction of the data lines 14 in one frame period (1F) as described above. Therefore, a difference between the data lines 14 and the pixels in which the precharge voltage is written and the data lines 14 and the pixels in which the precharge voltage is not written is not easily recognized even if processing is performed in units of one horizontal scanning period (1H). As a result, it is possible to suppress occurrence of rotation noise and to shorten one horizontal scanning period (1H) by the thinning drive of the precharge voltage.

According to the embodiment, the odd-numbered selection signals and the even-numbered selection signals are alternately selected or not selected in the direction of the scanning lines 12 and the direction of the data lines 14 without requiring a change in a duty ratio of the selection signals SEL[1] to SEL[8] in one horizontal scanning period (1H). Therefore, it is possible to simplify the control.

Second Embodiment

Figure 10:
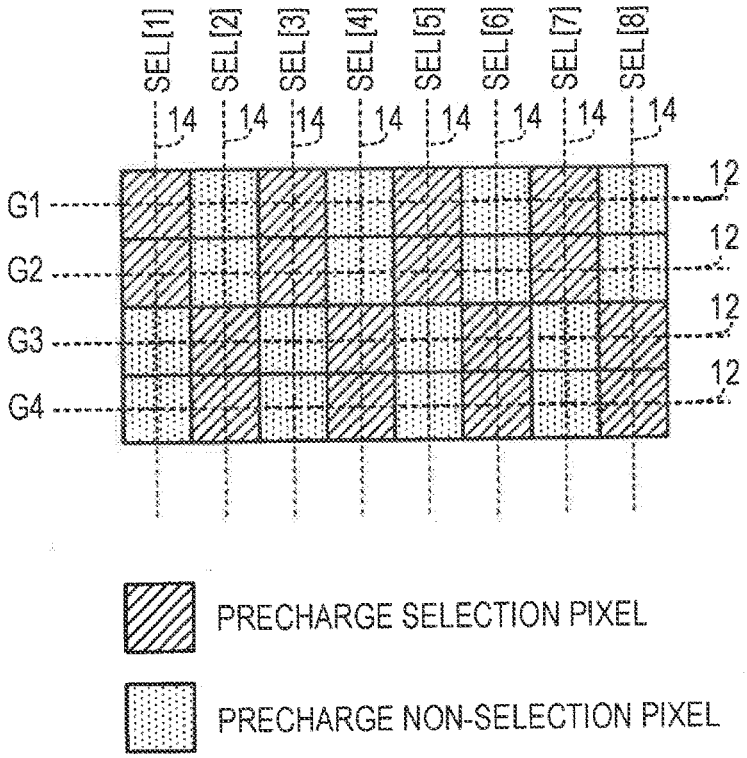
FIG. 10 is a diagram illustrating a data line selected and non-selected pattern during supply of a precharge voltage in an n-th frame according to a second embodiment.
Figure 11:
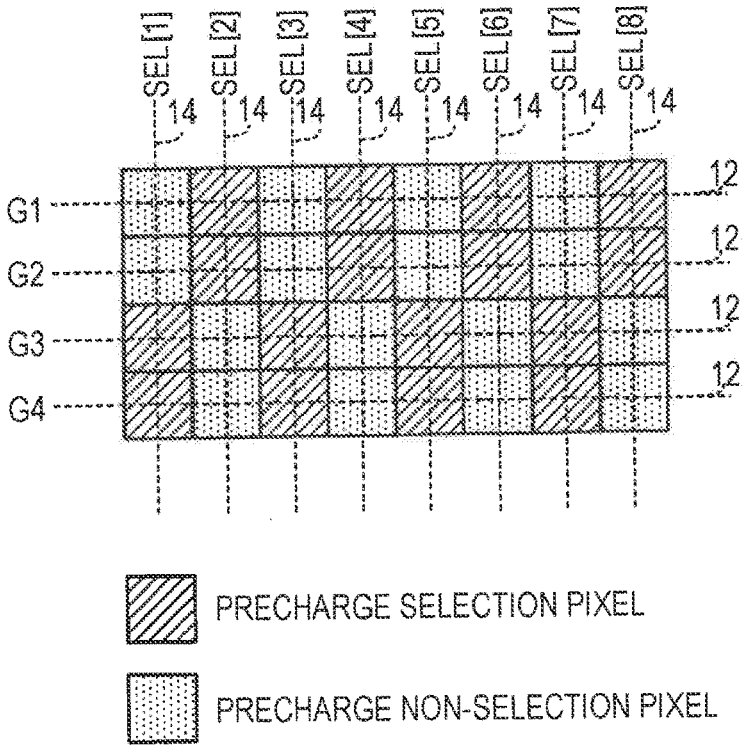
FIG. 11 is a diagram illustrating a data line selected and non-selected pattern during supply of the precharge voltage in an n+1-th frame according to the second embodiment.
Figure 12:
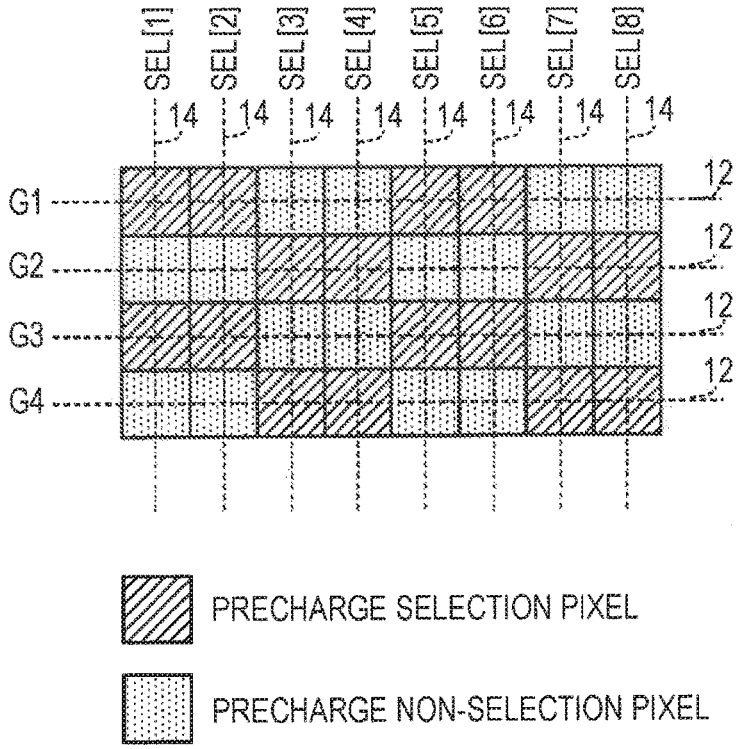
FIG. 12 is a diagram illustrating another data line selected and non-selected pattern during supply of the precharge voltage in the n-th frame according to the second embodiment.
Figure 13:
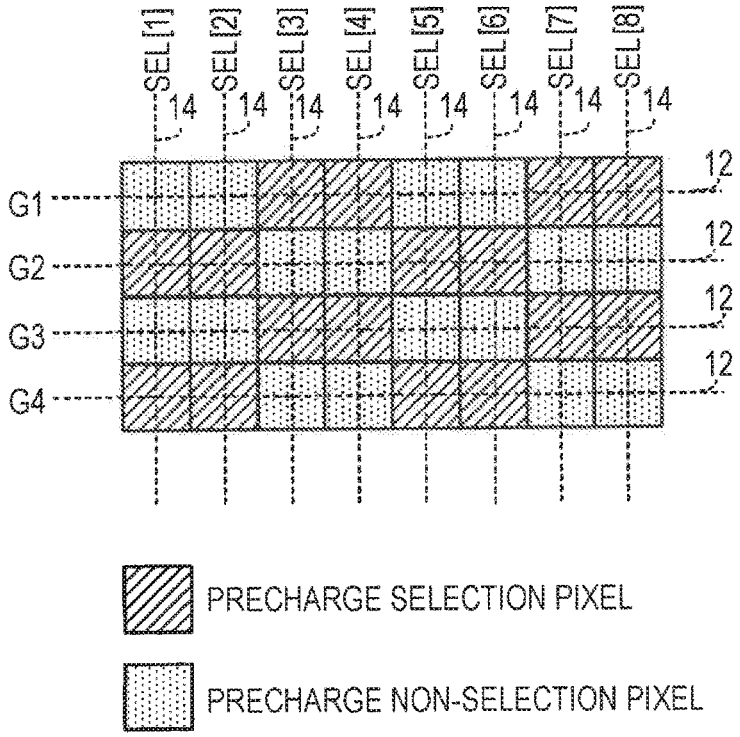
FIG. 13 is a diagram illustrating another data line selected and non-selected pattern during supply of the precharge voltage in the n+1-th frame according to the second embodiment.

Next, description will be given of a second embodiment of the invention with reference to FIGS. 10 to 13. FIG. 10 is a diagram illustrating a selected and non-selected pattern of the data lines 14 and the pixels when the precharge voltage is supplied in the n-th frame according to the embodiment. FIG. 11 is a diagram illustrating a selected and non-selected pattern of the data lines 14 and the pixels when the precharge voltage is supplied in the n+1-th frame according to the embodiment. FIG. 12 is a diagram illustrating another selected and non-selected pattern of the data lines 14 and the pixels when the precharge voltage is supplied in the n-th frame according to the embodiment. FIG. 13 is a diagram illustrating another selected and non-selected pattern of the data lines 14 and the pixels when the precharge voltage is supplied in the n+1-th frame according to the embodiment.

Although 1-bit counters are used as the H counter 41 and the V counter 42 in the first embodiment, the invention is not limited to such a configuration. For example, the H counter 41 may be formed of a 2-bit counter. As illustrated in FIG. 10, the odd-numbered selection signals SEL[1], SEL[3], SEL[5], and SEL[7] are set in the active level when values of the H counter 41 are "0" and "1" in the first vertical scanning period V. The even-numbered selection signals SEL[2], SEL[4], SEL[6], and SEL[8] are set in the active level when the values of the H counters 41 are "2" and "3".

Similarly, the even-numbered selection signals SEL[2], SEL[4], SEL[6], and SEL[8] are set in the active level when values of the H counter 41 are "0" and "1" in the next vertical scanning period V as illustrated in FIG. 11. In addition, the odd-numbered selection signals SEL[1], SEL [3], SEL[5], and SEL[7] are set in the active level when values of the H counter 41 are "2" and "3".

Even in the case of performing control as described above, every other data lines 14 and pixels 1 are not selected, and the precharge voltage is not written in these data lines 14 and the pixels in the same manner as in the first embodiment in the direction of the scanning lines 12. However, the data lines 14 and the pixels are not selected in a different pattern from that in the previous two horizontal scanning periods (2H) for every two horizontal scanning periods (2H) in the direction of the data lines 14. The precharge voltage is also not written in these data lines 14 and the pixels.

It Is possible to disperse the data lines 14 and the pixels in which the precharge voltage is written and the data lines 14 and the pixels in which the precharge voltage is not written even by such a control method. Therefore, a difference between the data lines 14 and the pixels in which the precharge voltage is written and the data lines 14 and the pixels in which the precharge voltage is not written is not easily recognized even if processing is performed in units of one horizontal scanning period (1H). As a result, it is possible to suppress occurrence of rotation noise and to shorten one horizontal scanning period H by the thinning drive of the precharge voltage. According to the embodiment, the odd-numbered selection signals and the even-numbered selection signals are alternately selected or not selected in the direction of the scanning lines 12 and the direction of the data lines 14 without requiring a change in a duty ratio of the selection signals SEL[1] to SEL[8] in one horizontal scanning period. Therefore, it is possible to simplify the control.

Even in the case where the H counter 41 is formed of a 1-bit counter, control may be performed such that every two data lines 14 and pixels are not selected as illustrated in FIGS. 12 and 13. That is, the first and second selection signals SEL[1] and SEL[2] and the fifth and sixth selection signals SEL[5] and SEL[6] are set in the active level when the value of the V counter 42 is "0" and the value of the H counter 41 is "0" as illustrated in FIG. 12. In addition, the third and fourth selection signals SEL[3] and SEL[4] and the seventh and eighth selection signals SEL[7] and SEL[8] are set in the non-active level. Similarly, the third and fourth selection signals SEL[3] and SEL[4] and the seventh and eighth selection signals SEL[7] and SEL[8] are set in the active level when the value of the H counter 41 is "I". In addition, the first and second selection signals SEL[1] and SEL[2] and the fifth and sixth selection signals SEL[5] and SEL[6] are set in the non-active level.

Furthermore, in the case where the value of the V counter 42 is "1", the third and fourth selection signals SEL[3] and SEL[4] and the seventh and eighth selection signals SEL[7] and SEL[8] are set in the active level when the value of the H counter 41 is "0" as illustrated in FIG. 13. In addition, the first and second selection signals SEL[1] and SEL[2] and the fifth and sixth selection signals SEL[5] and SEL[6] are set in the non-active level. When the value of the H counter 41 is "1", the first and second selection signals SEL1[1] and SEL[2] and the fifth and sixth selection signals SEL[5] and SEL[6] are set in the active level. In addition, the third and fourth selection signals SEL[3] and SEL[4] and the seventh and eighth selection signals SEL[7] and SEL[8] are set in the non-active level.

It Is possible to disperse the data lines 14 and the pixels in which the precharge voltage is written and the data lines 14 and the pixels in which the precharge voltage is not written even by such a control method. Therefore, a difference between the data lines 14 and the pixels in which the precharge voltage is written and the data lines 14 and the pixels in which the precharge voltage is not written is not easily recognized even if processing is performed in units of one horizontal scanning period. As a result, it is possible to suppress occurrence of rotation noise and to shorten one horizontal scanning period (1H) by the thinning drive of the precharge voltage. According to the embodiment, the odd-numbered selection signals and the even-numbered selection signals are alternately selected or not selected in the direction of the scanning lines 12 and the direction of the data lines 14 without requiring a change in a duty ratio of the selection signals SEL[1] to SEL[8] in one horizontal scanning period (1H). Therefore, it is possible to simplify the control.

In addition, it is possible to suppress occurrence of rotation noise and to shorten one horizontal scanning period (1H) by the thinning drive of the precharge voltage even if selection or non-selection are not alternately performed in the direction of the scanning lines 12 and the direction of the data lines 14.

For example, it is possible set the first and fifth selection signals SEL[1] and SEL[5] in the active level in one horizontal scanning period (1H) in which the scanning lines 12 on the m-th row are selected, to set the second and sixth selection signals SEL[2] and SEL[6] in the active level in one horizontal scanning period (1H) in which the scanning lines 12 on the m+l-th row are selected, to set the third and seventh selection signals SEL[3] and SEL[7] in the active level in one horizontal scanning period (1H) in which the scanning lines 12 on the m+2-th row are selected, to set the fourth and eighth selection signals SEL[4] and SEL[8] in the active level in one horizontal in one horizontal scanning period (1H) in which the scanning lines 12 on the m+3-th row are selected to configure the precharge selection pixels in a predetermined vertical scanning period V, and to move the precharge selection pixels in the direction of the scanning lines every vertical scanning period V.

Modification Examples

The invention is not limited to the aforementioned embodiments, and for example, various modifications descried below can be made. It is a matter of course that the respective embodiments and the respective modification examples may be appropriately combined.

(1) Although the configuration in which the constant precharge voltages VPREa and VPREb are used for positive polarity drive and negative polarity drive, respectively, as the precharge voltages in the aforementioned embodiment, the invention is not limited to such a configuration. For example, the invention can be applied to so-called two-stage precharge drive in which a low-potential precharge voltage is supplied as precharge in the first stage for the purpose of improving image quality and high-potential precharge voltage is supplied in the second precharge for the purpose of supporting writing of image signals. In the two-stage precharge drive, the selection signals are set in the active level in each of the writing of the precharge voltage in the first stage and the writing of the precharge voltage in the second stage. Therefore, a selection signal for setting the active level and a selection signal for setting the non-active level may be selected in accordance with the examples of the aforementioned embodiments.

(2) In the aforementioned embodiments, each wiring group B[j] is formed of eight data lines 14, and the distribution circuit 56 is also configured to correspond to the eight data lines 14. As a result, eight selection signals, namely the selection signals SEL[1] to SEL[8] are used as the selection signals. However, the invention is not limited to such a configuration, and the number of the data lines 14 forming the wiring group B[j] and the number of the selection signals can be appropriately changed.

(3) The configuration in which every one or two data lines 14 and pixels were not selected in the precharge voltage writing period was described in the aforementioned embodiment. In addition, the configuration in which the data lines 14 and the pixels were not selected in a different pattern from that in the previous one or two horizontal scanning periods for every one or two horizontal scanning periods was described. However, the invention is not limited to such a configuration and the number of data lines 14 to be thinned and the number of horizontal scanning periods can be appropriately changed.

(4) Although a liquid crystal was exemplified as an example of the electrooptical material in the aforementioned embodiments, the invention is applied to electrooptical devices that use other electrooptical materials. The electrooptical material is a material with optical properties such as transmittance and luminance that vary in response to supply of an electric signal (a current signal or a voltage signal). For example, the invention can be applied to a display panel that uses light emitting elements such as an organic ElectroLuminescent (EL), inorganic EL, and light emitting polymer in the same manner as in the aforementioned embodiments. Also, the invention can be applied to an electrophoretic display pane using a microcapsule that includes colored liquid and white particles dispersed in the liquid as an electrooptical material in the same manner as in the aforementioned embodiments. Furthermore, the invention can be applied to a twist ball display panel using a twist ball with different colors applied to regions with different polarities as an electrooptical material in the same manner as in the aforementioned embodiments. The invention can also be applied to various electrooptical devices such as a toner display panel using a black toner as an electrooptical material and a plasma display panel using high-pressure gas such as helium or neon as an electrooptical material in the same manner as in the aforementioned embodiments.

Application Examples

Figure 14:
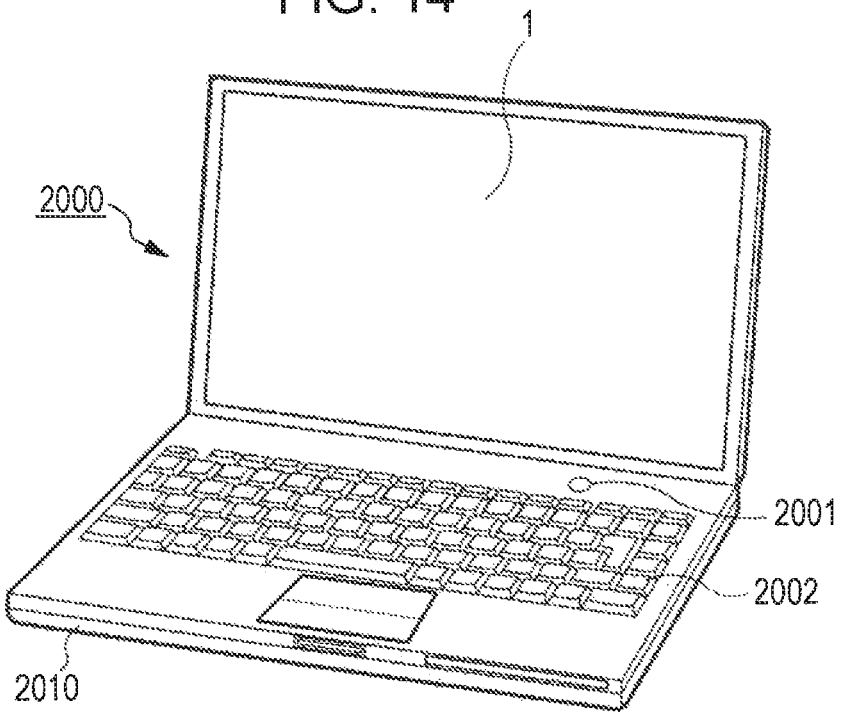
FIG. 14 is an explanatory diagram illustrating an example of an electronic device.
Figure 15:
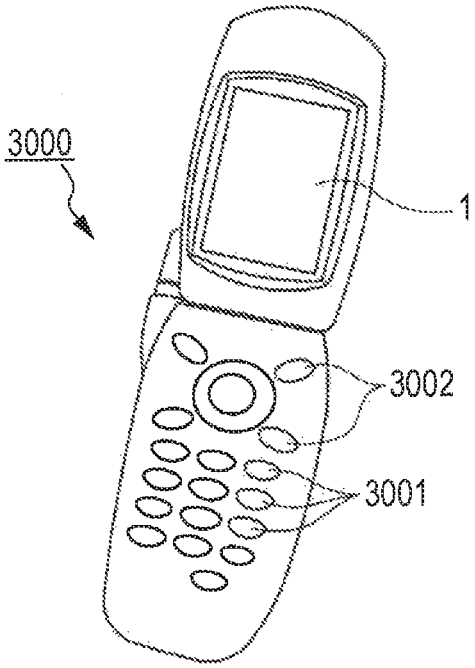
FIG. 15 is an explanatory diagram illustrating another example of the electronic device.
Figure 16:
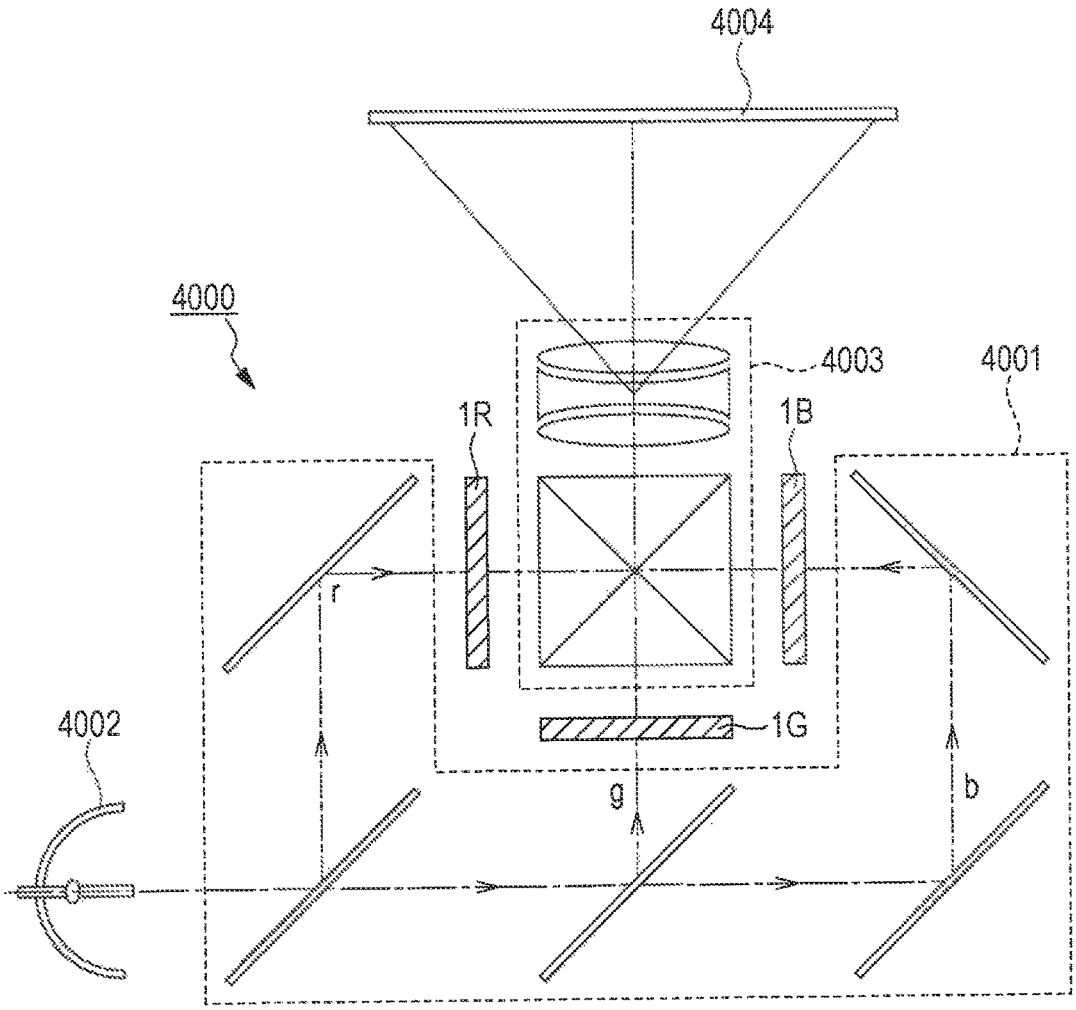
FIG. 16 is an explanatory diagram illustrating another example of the electronic device.

The invention can be utilized for various electronic devices. FIGS. 14 to 16 illustrate specific forms of the electronic devices as targets of applications of the invention.

FIG. 14 is a perspective view of a portable personal computer that employs the electrooptical device. A personal computer 2000 includes the electrooptical device 1 that displays various images and a main body 2010 with a power switch 2001 and a keyboard 2002 installed thereon.

FIG. 15 is a perspective view of a mobile phone. A mobile phone 3000 includes a plurality of operation buttons 3001, scroll buttons 3002, and the electrooptical device 1 that display various images. By operating the scroll buttons 3002, a screen displayed on the electrooptical device 1 is scrolled. The invention can also be applied to such a mobile phone.

FIG. 16 is a diagram schematically illustrating a configuration of a projection-type display apparatus (three-plate projector) 4000 that employs the electrooptical device. The projection-type display apparatus 4000 includes three electrooptical devices 1 (1R, 1G, and 1B) corresponding to different display colors R, G, and B, respectively. An illumination optical system 4001 supplies a red component r in light emitted from an illumination device (light source) 4002 to the electrooptical device 1R, supplies a green component g to the electrooptical device 1G, and supplies a blue component b to the electrooptical device 1B. The respective electrooptical devices 1 function as light modulators (light valves) that modulates the single color light supplied from the illumination optical system 4001 in accordance with a display image. A projection optical system 4003 synthesizes light emitted from the respective electrooptical devices 1 and projects the light to a projection surface 4004. The invention can also be applied to such a liquid crystal projector.

As electronic devices to which the invention is applied, a Personal Digital Assistant (PDA) is exemplified as well as the devices illustrated in FIGS. 1 and 14 to 16. In addition, a digital still camera, a television, a video camera, a car navigation device, a display for a vehicle (instrument panel), an electronic databook, electronic paper, a calculator, a word processor, a work station, a video phone, and a POS terminal are exemplified. Furthermore, a printer, a scanner, a copy machine, a video player, and a device provided with a touch panel are exemplified.

This application claims priority from Japanese Patent Application No. 2016-054112 filed in the Japanese Patent Office on Mar. 17, 2016, the entire disclosure of which is hereby incorporated by reference in its entirely.

What is claimed is:

1. An electrooptical device comprising:

a plurality of scanning lines;

a plurality of data lines;

pixels that are provided so as to correspond to intersections between the plurality of scanning lines and the plurality of data lines;

a scanning line drive circuit that supplies a scanning signal to the scanning lines;

a signal generation circuit that supplies, in one horizontal scanning period:

in a first period including a tone display period, a first voltage to the pixels via the data lines with a magnitude in accordance with a tone to be displayed; and in a second period that includes a fly-back period and is before the first period, a second voltage including a precharge voltage to the data lines;

a signal distribution circuit that is provided between the signal generation circuit and the data lines and selects the data lines; and a control circuit that:

controls the signal distribution circuit such that a predetermined number of data lines are alternately not selected in the second period; and controls the signal distribution circuit such that non-selection of the data lines is different every predetermined horizontal scanning period.

2. The electrooptical device according to claim 1, wherein the control circuit controls the signal distribution circuit such that odd-numbered data lines or even-numbered data lines are not selected in the second period and controls the signal distribution circuit such that non-selection of the data lines is different every horizontal scanning period.

3. A control method of an electrooptical device that includes a plurality of scanning lines, a plurality of data lines, and pixels that are provided so as to correspond to intersections between the plurality of scanning lines and the plurality of data lines, the method comprising:

in a first period in a horizontal scanning period, the first period including a tone display period, supplying a first voltage to the data lines with a magnitude in accordance with a tone to be displayed;

in a second period before the first period in the horizontal scanning period, the second period including a fly-back period, supplying a second voltage that is different from the first voltage and includes a precharge voltage to a predetermined number of data lines; and supplying the second voltage to different data lines every predetermined horizontal scanning period.

4. The control method of an electrooptical device according to claim 3, wherein the second voltage is supplied to either odd-numbered data lines or even-numbered data lines in the second period, and the second voltage is supplied to different data lines every horizontal scanning period.

5. An electronic device comprising:

the electrooptical device according to claim 1.

* * * * *